US010279977B2

(12) United States Patent
Fleischman et al.

(10) Patent No.: US 10,279,977 B2
(45) Date of Patent: May 7, 2019

(54) FLUID CONTAINER FOR HAVING STACKABLE SECTIONS CONNECTED BY VALVES FOR TRANSMITTING FLUID BETWEEN THE SECTIONS

(71) Applicants: Eli Fleischman, Brooklyn, NY (US); Isaac Meisels, Brooklyn, NY (US)

(72) Inventors: Eli Fleischman, Brooklyn, NY (US); Isaac Meisels, Brooklyn, NY (US)

( * ) Notice: Subject to any disclaimer, the term of this patent is extended or adjusted under 35 U.S.C. 154(b) by 0 days.

(21) Appl. No.: 15/686,492

(22) Filed: Aug. 25, 2017

(65) Prior Publication Data

US 2019/0062033 A1 Feb. 28, 2019

(51) Int. Cl.
*B65D 21/02* (2006.01)
*B65D 81/32* (2006.01)

(52) U.S. Cl.
CPC ..... *B65D 81/3211* (2013.01); *B65D 21/0228* (2013.01); *Y10T 137/8622* (2015.04); *Y10T 137/86196* (2015.04)

(58) Field of Classification Search
CPC ..... F16L 37/34; Y10T 137/86196; Y10T 137/87925; Y10T 137/87941; Y10T 137/87949; Y10T 137/87957; Y10T 137/8622; B65D 21/0228; B65D 21/02
See application file for complete search history.

(56) References Cited

U.S. PATENT DOCUMENTS

| | | | | |
|---|---|---|---|---|
| 896,903 | A | 8/1908 | Ferry | |
| 3,347,410 | A | 10/1967 | Schwartzman | |
| 3,349,966 | A | 10/1967 | Schwartzman | |
| 3,548,562 | A | 12/1970 | Schwartzman | |
| 3,610,586 | A | 10/1971 | Price et al. | |
| 4,177,938 | A | 12/1979 | Brine | |
| 4,244,467 | A | 1/1981 | Cavazza | |
| 4,638,927 | A | 1/1987 | Morane | |
| 4,682,689 | A | 7/1987 | Pereira et al. | |
| 4,779,722 | A | 10/1988 | Hall | |
| 4,785,931 | A | 11/1988 | Weir et al. | |
| 4,984,723 | A | 1/1991 | Hsu | |
| 5,152,965 | A | 10/1992 | Fisk et al. | |
| 5,277,303 | A | 1/1994 | Goyet et al. | |
| 5,636,654 | A * | 6/1997 | Helm | B60K 15/03 137/15.01 |
| 5,638,968 | A | 6/1997 | Baron et al. | |

(Continued)

*Primary Examiner* — Kevin Lee

(74) *Attorney, Agent, or Firm* — Ezra Sutton

(57) ABSTRACT

A fluid container adapted for leak proof connection with one or more substantially similar fluid containers, wherein a first cylindrical body with a first top neck and a first bottom recess is vertically stacked with at least a second cylindrical body with a second top neck and a second bottom recess. The second top neck of the second body is received within the first bottom recess of the first body, and the first male valve is received in the first top neck of the first body, and a second male valve is received within the second top neck of a second body. In addition, a first female valve is received within the first bottom recess of the first body, and a second female valve is received in the second bottom recess of the second body. In this manner, the first and second bodies are vertically stacked, and the second male valve of the second body is received within the first female valve of the first bottom recess of the first body for allowing movement of liquid between the first and second bodies.

9 Claims, 9 Drawing Sheets

(56) References Cited

U.S. PATENT DOCUMENTS

| | | | | |
|---|---|---|---|---|
| 5,647,481 | A | 7/1997 | Hundertmark et al. | |
| 5,884,759 | A | 3/1999 | Gueret | |
| 6,068,396 | A | 5/2000 | Baudin | |
| 6,073,803 | A | 6/2000 | Sturm et al. | |
| 6,135,275 | A | 10/2000 | Kelders et al. | |
| 6,161,355 | A | 12/2000 | Gratt | |
| D439,156 | S | 3/2001 | Hall et al. | |
| 6,481,571 | B1 | 11/2002 | Kelders et al. | |
| RE38,067 | E | 4/2003 | Gueret | |
| 7,066,323 | B1 | 6/2006 | Reisman | |
| 7,308,915 | B2 | 12/2007 | Johns et al. | |
| 7,331,478 | B2 | 2/2008 | Aljadi | |
| 7,377,383 | B2 | 5/2008 | Henry | |
| 8,292,099 | B1 | 10/2012 | Wahlstrom | |
| 8,459,450 | B1 | 6/2013 | Whitaker et al. | |
| 8,544,649 | B2 | 10/2013 | Rivera et al. | |
| 9,004,301 | B2 | 4/2015 | Wahlstrom | |
| 9,231,323 | B1 * | 1/2016 | Jaeger | F16L 37/002 |
| 9,278,781 | B1 | 3/2016 | Boldis | |
| 2002/0104766 | A1 | 8/2002 | de Laforcade | |
| 2003/0183651 | A1 * | 10/2003 | Greer, Jr. | B01F 13/002 222/129 |
| 2005/0263193 | A1 * | 12/2005 | Carmack et al. | F16L 37/32 137/614.04 |
| 2006/0049127 | A1 | 3/2006 | Katz | |
| 2006/0096942 | A1 | 5/2006 | Lane | |
| 2006/0255000 | A1 | 11/2006 | Quintana | |
| 2008/0169265 | A1 | 7/2008 | Huang et al. | |
| 2008/0289976 | A1 | 11/2008 | Henry | |
| 2009/0127221 | A1 | 5/2009 | Nasrallah | |
| 2009/0266782 | A1 | 10/2009 | Lane | |
| 2010/0072160 | A1 | 3/2010 | Hayes | |
| 2010/0213156 | A1 | 8/2010 | Belnap | |
| 2012/0308357 | A1 | 12/2012 | Friesen et al. | |
| 2013/0111726 | A1 | 5/2013 | Krieger | |

* cited by examiner

FLUID CONTAINER FOR HAVING STACKABLE SECTIONS CONNECTED BY VALVES FOR TRANSMITTING FLUID BETWEEN THE SECTIONS

FIELD OF THE INVENTION

The present invention relates to a fluid container for having stackable sections connected by valves for transmitting fluid between the sections.

BACKGROUND OF THE INVENTION

Vertically stackable fluid containers that interlock with each other are known in the prior art. However, the prior art does not provide selectively adjacent stackable fluid containers having interlocking valves operated by springs to provide a fluid type connection.

DESCRIPTION OF THE PRIOR ART

When carrying liquids and the like, there may be instances in which variation in the volume of the fluid container is desired. For example, during airline travel, regulations relating to liquid volumes in a user's luggage may dictate the volume of a user's fluid container. Further, the use of multiple separate fluid containers in a user's luggage may lead to the containers being lost, mixed, and undesirably shifted during travel. This not only makes it more difficult for travelers to carry multiple fluid bottles, but also makes it difficult for travelers to mix the contents of separate fluid containers.

Accordingly, attempts have been made in the art to solve these problems by simply interlocking separately sealed fluid containers. Examples of interlocking containers may be found in U.S. Pat. Nos. 896,903; 4,984,723; 6,161,355; 8,544,649; D439,156; U.S. Pat. No. 9,278,781 and U.S. patent application publication 2006/0096942; 2006/0255000; 2009/0266782; 2012/0308357; 2013/0111726.

In addition, numerous attempts have been made in the art to have attachable and vertically stackable containers having integral chambers containing mixable fluid and/or powders, with permeable or frangible valves, whereby the fluid or powder of one container can be mixed with the fluid or powder of the other container. For instance, numerous such bottles have been disclosed for storing a dry powdered mixture within a bottle, e.g., powdered ice tea, coffee, baby formula, sports drink mixtures, vitamins, etc., until just prior to consumption, with provisions for rapidly combining and mixing the powder with the liquid in an adjacent container, without opening the bottle. Moreover, these bottles allow different liquids and powders, for example dry mixes to flow through and into each other to facilitate mixing. Likewise, there are numerous fluid containers disclosed in the prior art having integral chambers containing fruit or herbs. These fluid containers infuse a fruit or herb flavor into a liquid inside the container. The container is segregated into a top liquid chamber, and a bottom flavor infusion chamber. However, a major drawback of each of these prior art containers is that once the integral chamber dispels its contents into the liquid of the container, the integral chamber cannot be refilled and the container containing the liquid mixture is usually disposed of. Also, the integral chamber usually only contains one choice of mixable contents which cannot be selectively mixed with different liquids or powders.

Examples of these aforementioned mixing and dispensing containers having segregated mixing chambers may be found in U.S. Pat. Nos. 3,347,410; 3,349,966; 3,548,562; 3,610,586; 4,177,938; 4,244,467; 4,638,927; 4,682,689; 4,779,722; 4,785,931; 5,152,965; 5,277,303; 5,638,968; 5,647,481; 5,884,759 (reissued as Re38,067); U.S. Pat. Nos. 6,068,396; 6,073,803; 6,135,275; 6,481,571; 7,066,323; 7,308,915; 7,331,478; 7,377,383; 8,292,099; 8,459,450; 9,004,301; and in U.S. patent application publication nos. 2002/0104766; 2006/0049127; 2008/0169265; 2008/0289976; 2009/0127221; 2010/0072160; 2010/0213156.

However, none of the aforementioned prior art references discloses multiple fluid containers that can be detachably and selectively stacked on top of one another, wherein each adjacent container includes valves for advantageously and selectively allowing the fluids in each of the connected adjacent containers to move and mix with each other through each of the connected fluid containers, using the interconnected and lockable male and female valves, which may be spring actuated.

Accordingly, the selective connection of multiple adjacent valved fluid containers of the claimed invention advantageously permit the selective mixing of different liquids, powders, including for example, powdered ice tea, coffee, baby formula, sports drink mixtures, vitamins, or fruits, etc. by simply selectively connecting adjacent containers filled with the respective desired contents to be mixed. In addition, when the adjacent containers containing the desired contents are connected, their contents can be selectively mixed since the valves permit the user to selectively control the amount of contents to flow from one adjacent container to the other. Thus, the claimed invention provides for a stacked, valved container that is easily portable on all types of vehicles, including cars, planes boats, etc., and presents a reusable, selective, no mess solution to the aforementioned prior art containers.

OBJECTS OF THE INVENTION

It is an object of the present invention to provide a fluid container for having adjacent stackable sections connected by valves for transmitting fluid between the sections.

Another object of the present invention is to provide male and female valves at the top and bottom of each section for interlocking with the valves of adjacent sections.

Another object of the present invention is to provide a fluid container for having stackable sections connected by valves for a leak proof type connection between the adjacent stackable sections.

Another object of the present invention is to provide a fluid container which permits the selective connection of multiple adjacent valved fluid containers.

Another object of the present invention is to provide a fluid container which permits the selective mixing of different liquids, powders, including for example, powdered ice tea, coffee, baby formula, sports drink mixtures, vitamins, or fruits, etc. by simply selectively connecting adjacent containers filled with the respective desired contents to be mixed.

Another object of the present invention is to provide a fluid container such that when adjacent containers containing the desired contents are connected, their contents can be selectively mixed since the valves permit the user to selectively control the amount of contents to flow from one adjacent container to the other.

Another object of the present invention is to provide a fluid container which provides for a stacked, valved container that is easily portable on all types of vehicles, including cars, planes boats, etc.

Another object of the present invention is to provide a fluid container that is selectively and reusably connectable without causing any spillage of the contents of each separately valved container sections.

SUMMARY OF THE INVENTION

The present invention provides a fluid container adapted for leak proof and selective connection with one or more substantially similar fluid containers, wherein a first cylindrical body with a first top neck and a first bottom recess is vertically stacked with at least a second cylindrical body with a second top neck and a second bottom recess. The second top neck of the second body is received within the first bottom recess of the first body, and the first male valve is received in the first top neck of the first body, and a second male valve is received within the second top neck of a second body. In addition, a first female valve is received within the first bottom recess of the first body, and a second female valve is received in the second bottom recess of the second body. In this manner, the first and second bodies are vertically stacked, and the second male valve of the second body is received within the first female valve of the first bottom recess of the first body for allowing movement of liquid between the first and second bodies.

DETAILED DESCRIPTION OF THE PREFERRED EMBODIMENT

Figure 1:
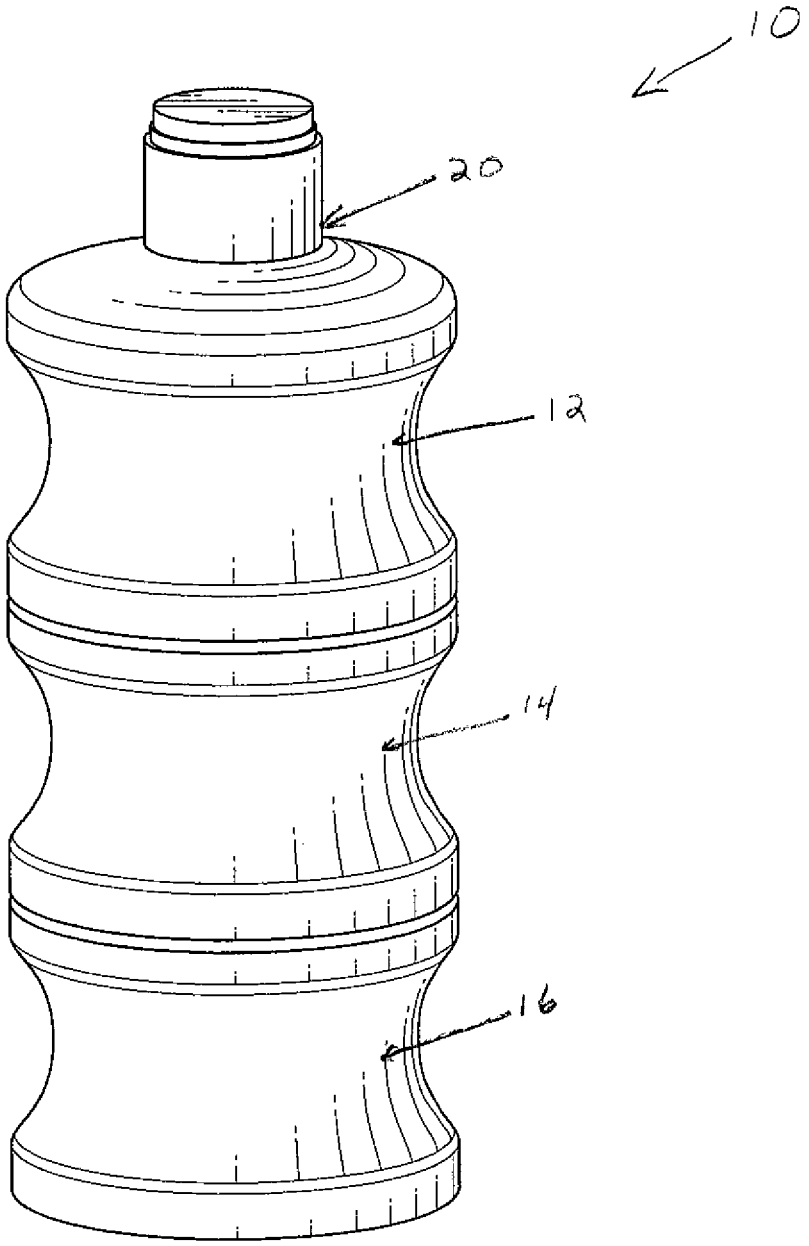
FIG. 1 is a perspective view of a stack of fluid container sections connected to each other by connecting valves.
Figure 2:
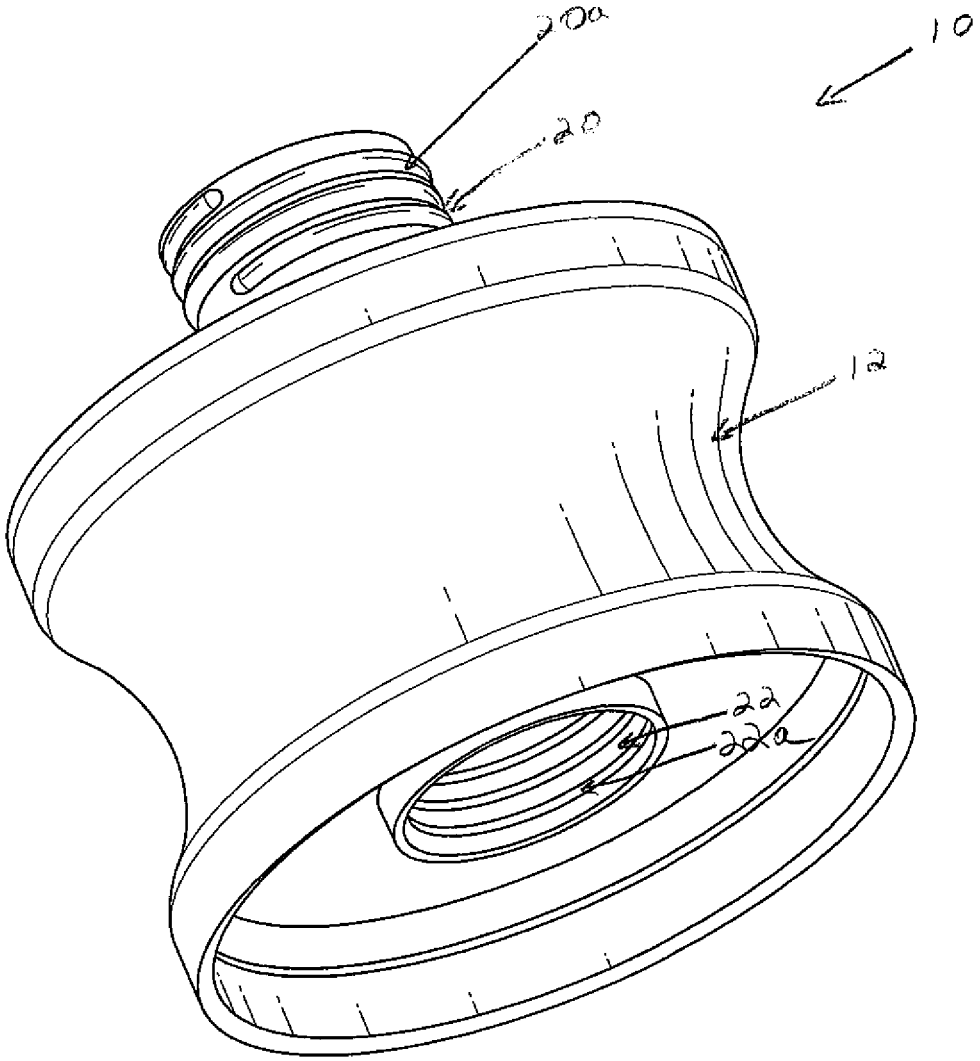
FIG. 2 is a perspective view of one stackable fluid section of the fluid container.
Figure 3:
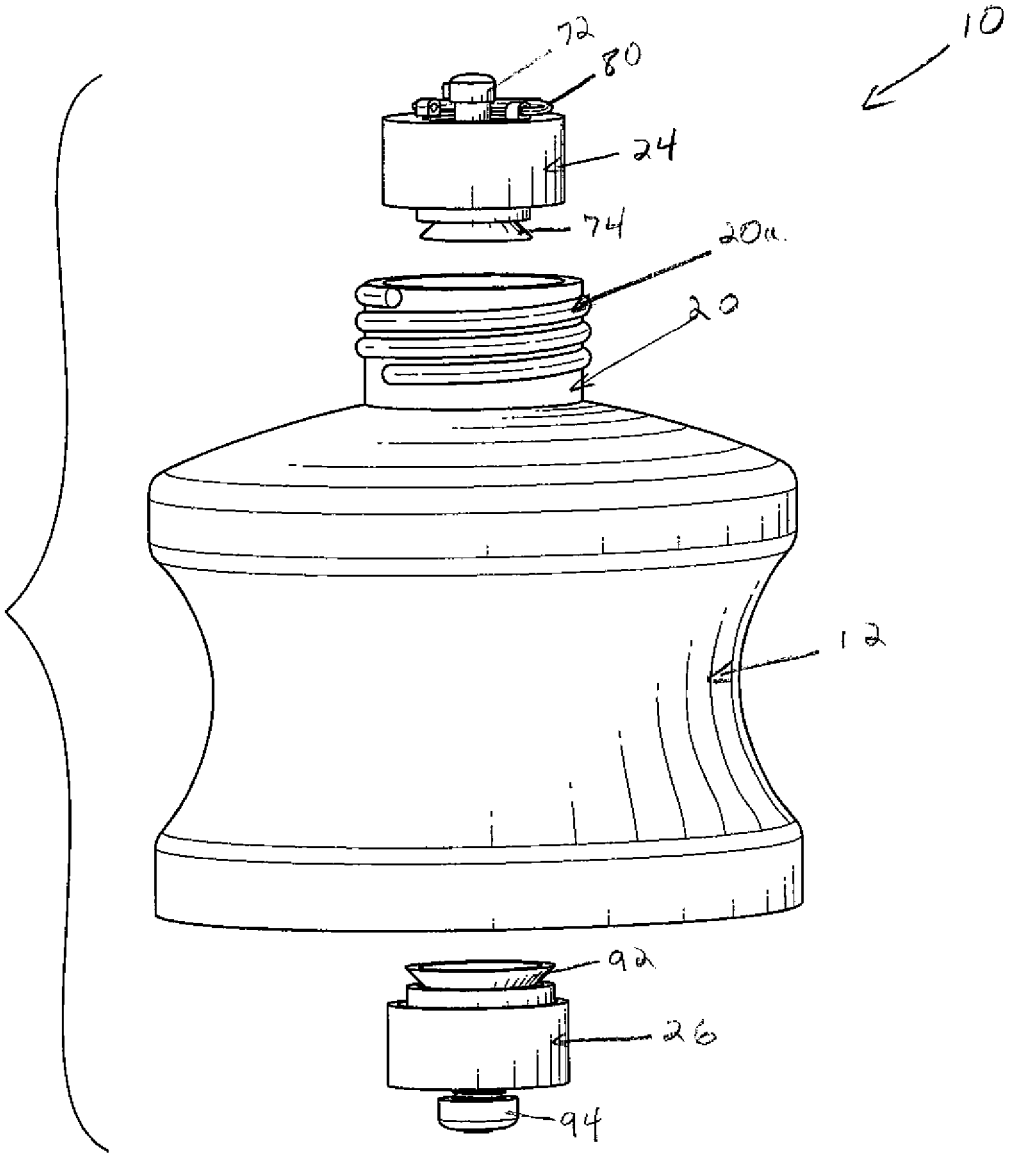
FIG. 3 is an exploded view of one stackable fluid section of the fluid container with the top male valve shown above the top threaded portion of the stackable section, and the bottom female valve shown below the base of the stackable section.

The present invention, as shown in FIG. 1, provides a fluid container 10 adapted for leak proof connection having one or more substantially similar fluid container sections 12, 14, 16. The first cylindrical body 12, shown in FIGS. 2 and 3, has a first top neck 20 and a first bottom recess 22. Also, a first male valve 24 is received in the first top neck 20 of the first cylindrical body 12. In addition, a first female valve 26 is received within the first bottom recess 22 of the first cylindrical body 12.

Similarly, as shown in FIGS. 1, 4, 5, and 6, the second cylindrical body 14 has a second top neck 30 and a second bottom recess 32. Also, a second male valve 34 is received in the second top neck 30 of the second cylindrical body 14. In addition, a second female valve 36 is received within the second bottom recess 32 of the second cylindrical body 14 that is identical in structure to the first female valve 26.

Figure 4:
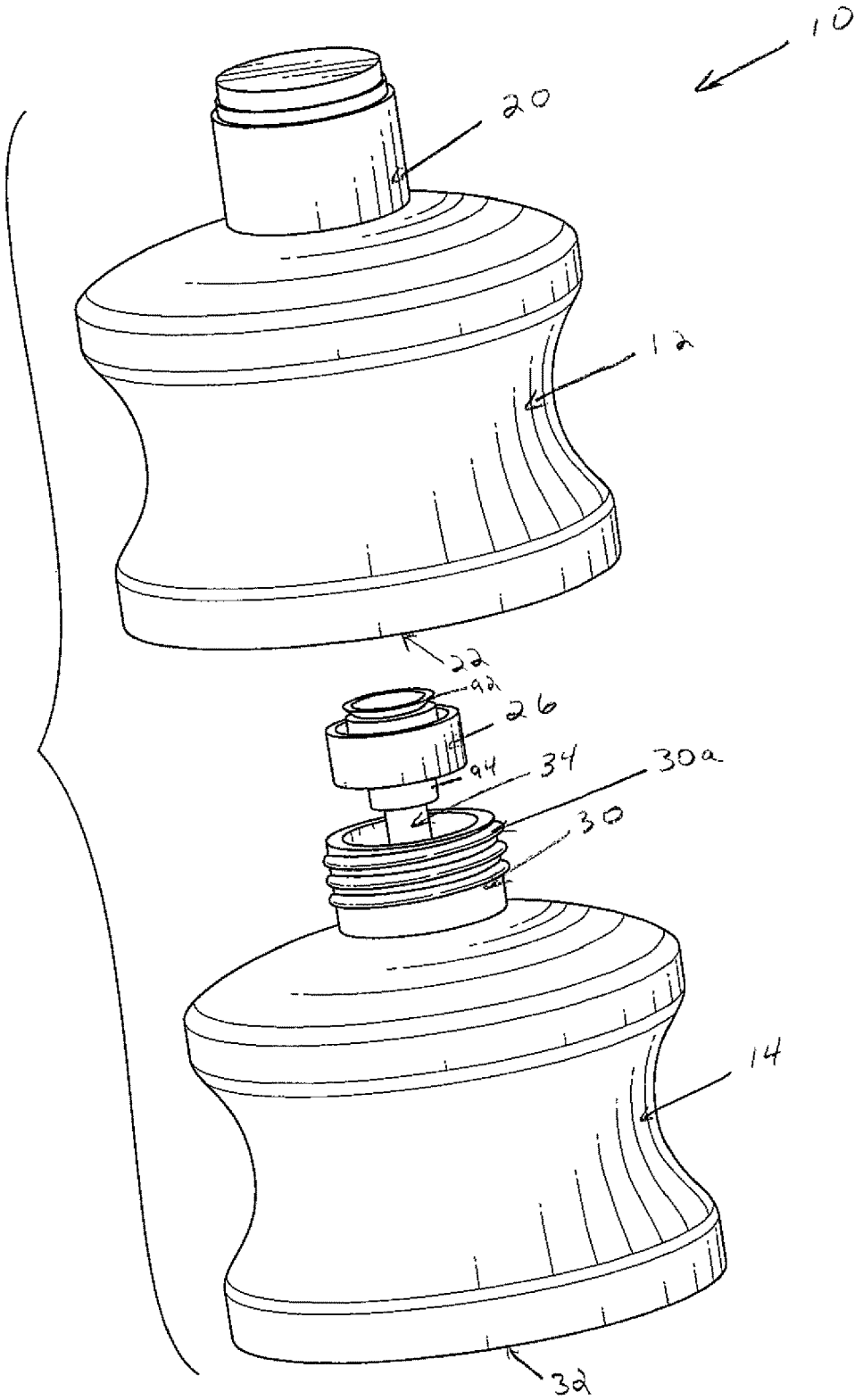
FIG. 4 is an exploded view of two stackable fluid sections with the top male valve shown above the top threaded portion of the bottom stackable fluid section and the female valve shown below the base of the top stackable section, and wherein the male valve section is shown being inserted into the female valve section.
Figure 5:
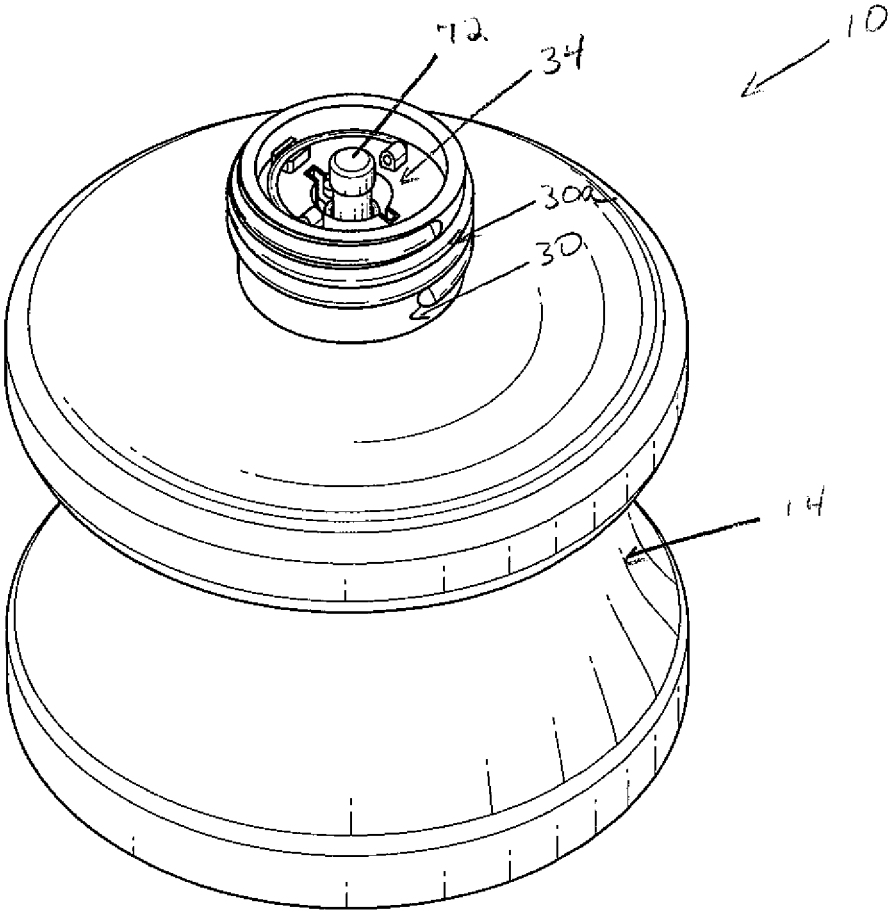
FIG. 5 is a perspective view of one stackable fluid section of the fluid container shown with the male valve in the top threaded portion of the stackable section.
Figure 6:
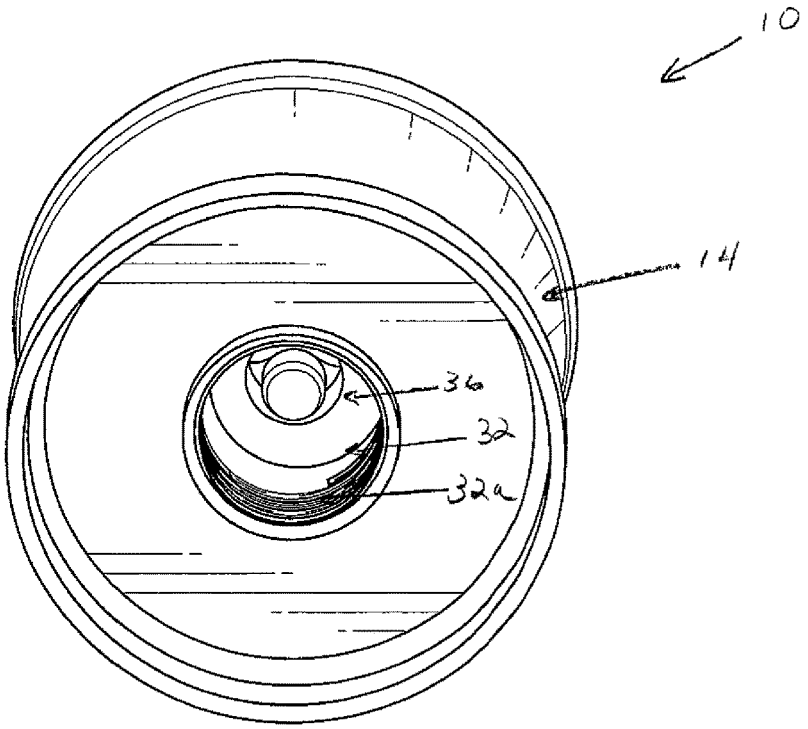
FIG. 6 is a bottom view of one stackable section of the fluid container shown with the female valve in the bottom portion of the stackable section.

In order to stackably attach the adjacent first cylindrical body 12 and second cylindrical body 14, as shown in FIG. 4, the second top neck 30 of the second cylindrical body 14 is attached and received within the first bottom recess 22 of the first cylindrical body 12. In this manner, the second male valve 34 in the second top neck 30 of the second cylindrical body 14 is mateably attached to the first female valve 26 in the first bottom recess 22 of the first cylindrical body 12. Thus, the first cylindrical body 12 and the second cylindrical body 14 can be selectively and vertically stacked so that the contents of the first cylindrical body 12 and the second cylindrical body 14, including, e.g., liquid, powder, food stuffs, etc., can move and be mixed between the first cylindrical body 12 and the second cylindrical body 14.

Similarly, an adjacent third cylindrical body 16, shown in FIG. 1, may be vertically attached to the second cylindrical body 14 in the same manner as the second cylindrical body 14 is attached to the first cylindrical body 12, as shown in FIG. 4. Like the first cylindrical body 12 and the second cylindrical body 14, the third cylindrical body 16 has a third top neck and a third bottom recess. Also, a third male valve is received in the third top neck of the third cylindrical body. In addition, a third female valve is received within the third bottom recess of the third cylindrical body 16.

In order to stackably attach the adjacent second and third cylindrical bodies 14, 16, as shown in FIG. 1, the third top neck of the third cylindrical body 16 is attached and received within the second bottom recess 32 of the second cylindrical body 14. In this manner, the third male valve in the third top neck of the third cylindrical body is mateably attached to the second female valve in the second bottom recess 32 of the second cylindrical body 14. Thus, as shown in FIGS. 1 and 4, the first cylindrical body 12, second cylindrical body 14, and third cylindrical body 16 can be selectively and vertically stacked so that the contents of the first cylindrical body 12, the second cylindrical body 14, and the third cylindrical body 16, including, e.g., liquid, powder, food stuffs, etc., can move and be mixed between the first cylindrical body 12, the second cylindrical body 14, and the third cylindrical body 16.

Similarly, an adjacent fourth cylindrical body may be vertically attached to the third cylindrical body 16 in the same manner as the first cylindrical body 12, the second cylindrical body 14, and the third cylindrical body 16 are attached together in FIG. 1. Like the first cylindrical body 12, the second cylindrical body 14, and the third cylindrical body 16, the fourth cylindrical body has a fourth top neck and a fourth bottom recess. Also, a fourth male valve is received in the fourth top neck of the fourth cylindrical body. In addition, a fourth female valve is received within the fourth bottom recess of the fourth cylindrical body.

In order to stackably attach the adjacent third cylindrical body 16 with the fourth cylindrical body, similar to the stack of the adjacently connected first cylindrical body 12, second cylindrical body 14, and the third cylindrical body 16, as shown in FIG. 1, the fourth top neck of the fourth cylindrical body is attached and received within the third bottom recess of the third cylindrical body 16. In this manner, the fourth male valve in the fourth top neck of the fourth cylindrical body is mateably attached to the third female valve in the third bottom recess of the third cylindrical body. Thus, similar to the attached first cylindrical body 12, second cylindrical body 14, and third cylindrical body 16, as shown in FIGS. 1 and 4, a fourth cylindrical body can be selectively and vertically attached to the first cylindrical body 12, second cylindrical body 14, and third cylindrical body 16. Thus, the contents of the first cylindrical body 12, second cylindrical body 14, third cylindrical body 16, and fourth cylindrical body, including, e.g., liquid, powder, food stuffs, etc., can move and be mixed between the first cylindrical body 12, the second cylindrical body 14, the third cylindrical body 16, and the fourth cylindrical body.

Since the first cylindrical body 12, second cylindrical body 14, third cylindrical body 16, and fourth cylindrical body may preferably each have substantially identical structures, it is contemplated that the first cylindrical body 12, second cylindrical body 14, third cylindrical body 16, and fourth cylindrical body can be each interchangeably attached to each other in various combinations so that the discreet contents of each cylindrical body may be selectively mixed with the contents of any one or more of another cylindrical body or bodies so that the desired mixture can be achieved.

Figure 7:
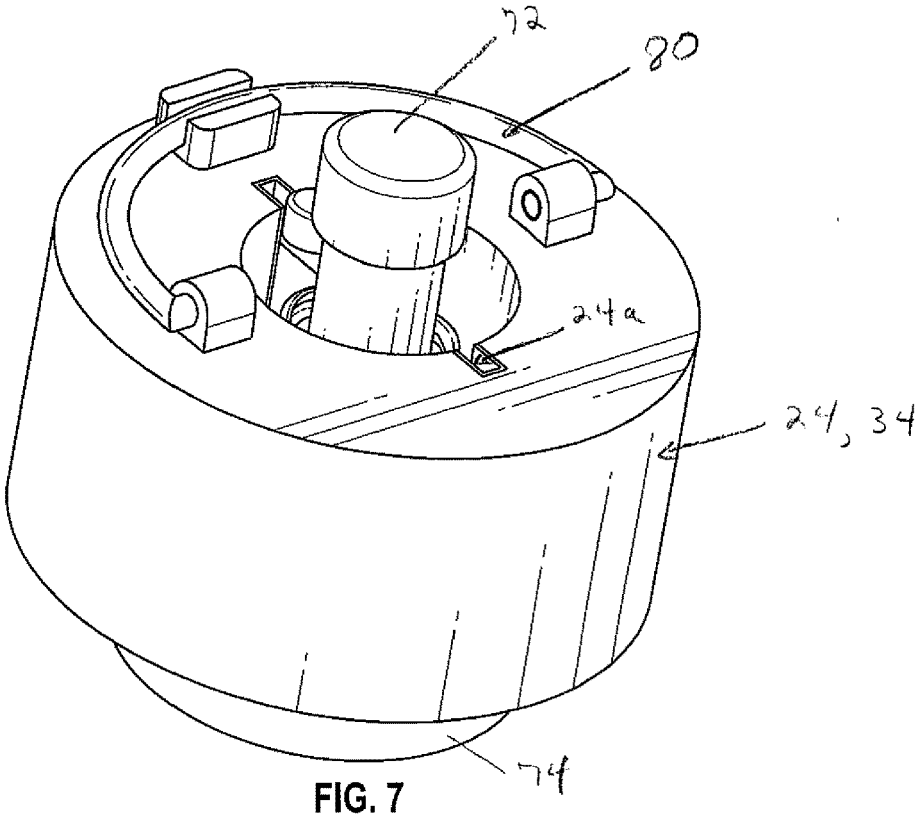
FIG. 7 is a perspective view of the top male valve.
Figure 8:
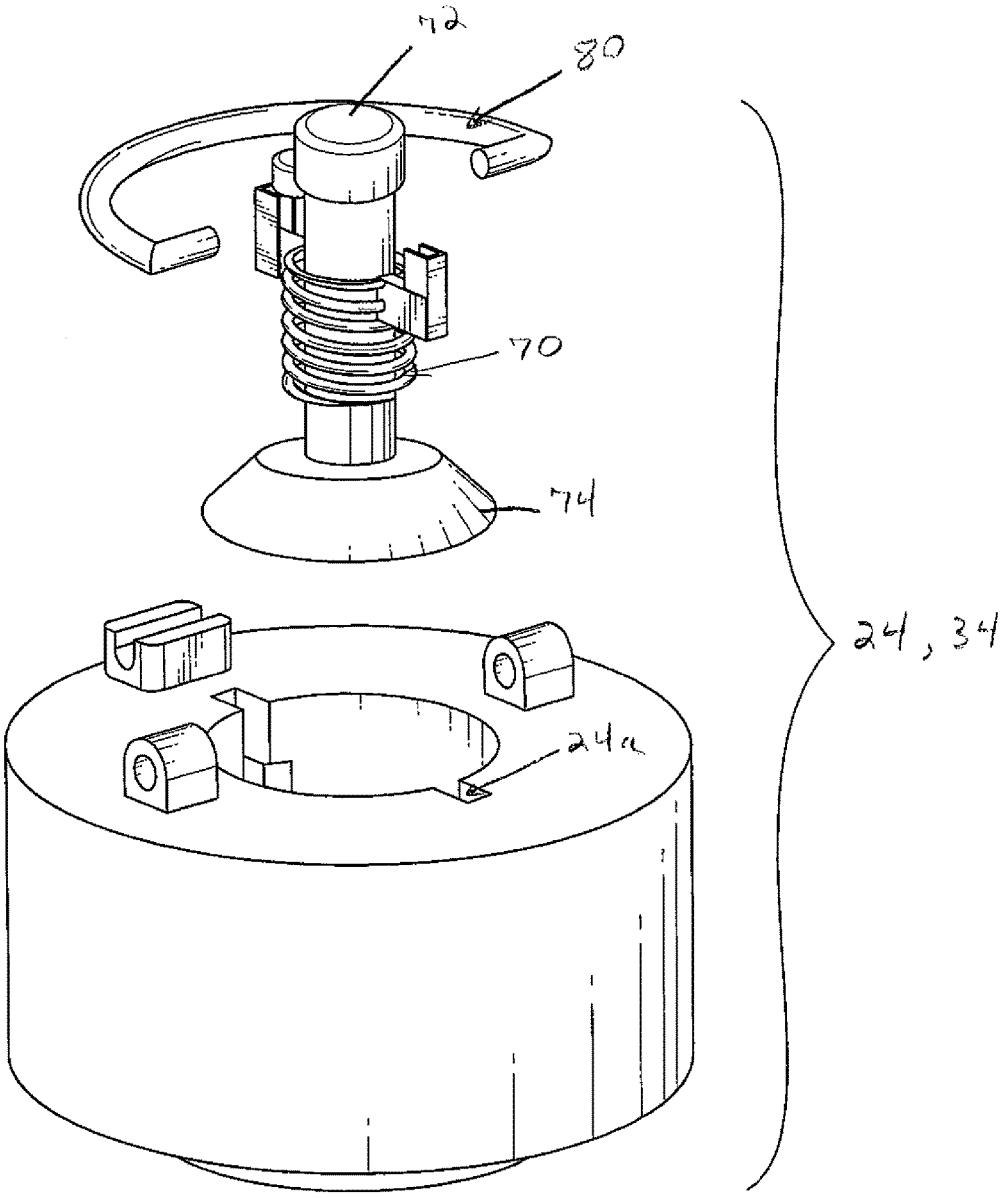
FIG. 8 is an exploded view of the top male valve with the spring section shown above the bottom section.

In addition, as shown in FIGS. 7 and 8, the first male valve 24, second male valve 34, and the third and fourth male valves may preferably each include a top member 72, a bottom member 74, and an inner spring 70 for being compressed upon insertion into each of the first female valve 26, second female valve 36, and third and fourth female valves. Further, the first male valve 24, second male valve 34, and third and fourth male valves may each include a notch 24*a*, as exemplary shown in FIGS. 7 and 8, that allows them to be locked with respect to each other when they are compressed upon insertion into each of the first female valve 26, second female valve 36, and third and fourth female valves.

Figure 9:
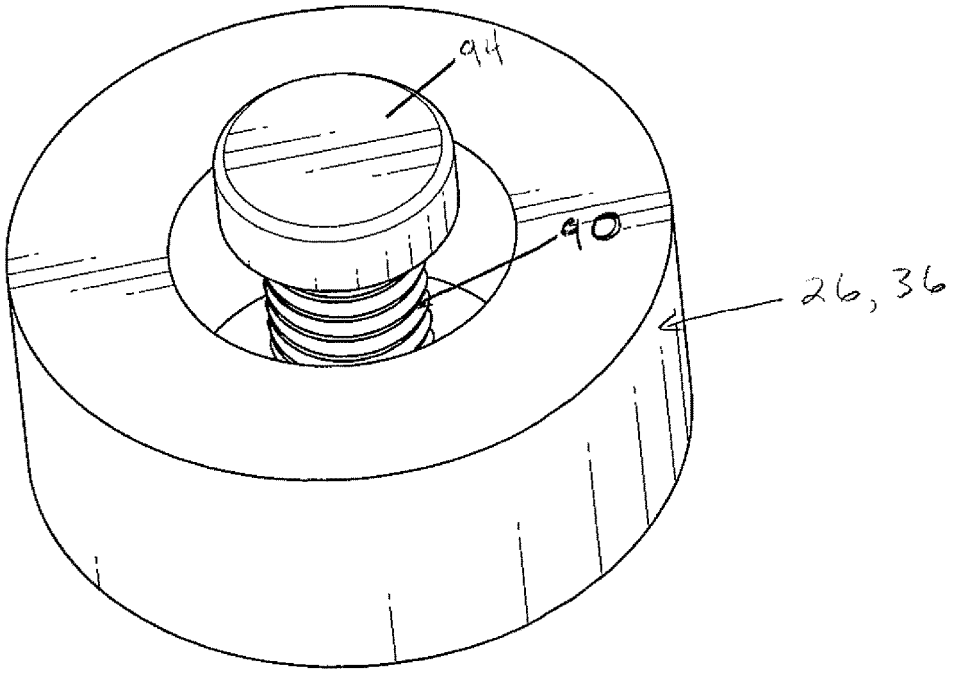
FIG. 9 is a bottom perspective view of the bottom female valve.
Figure 10:
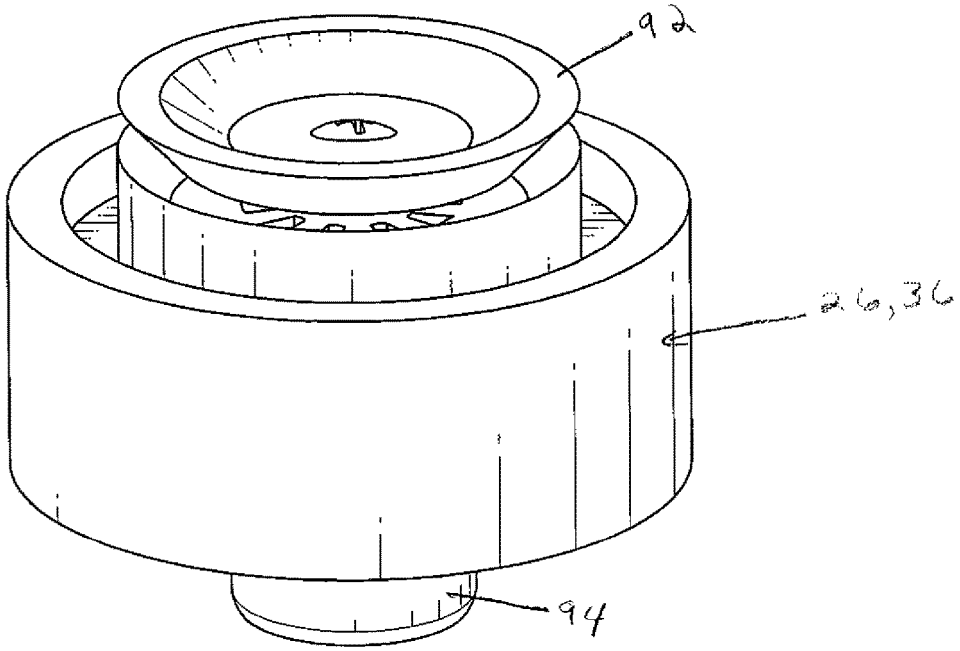
FIG. 10 is a top perspective view of the bottom female valve.
Figure 11:
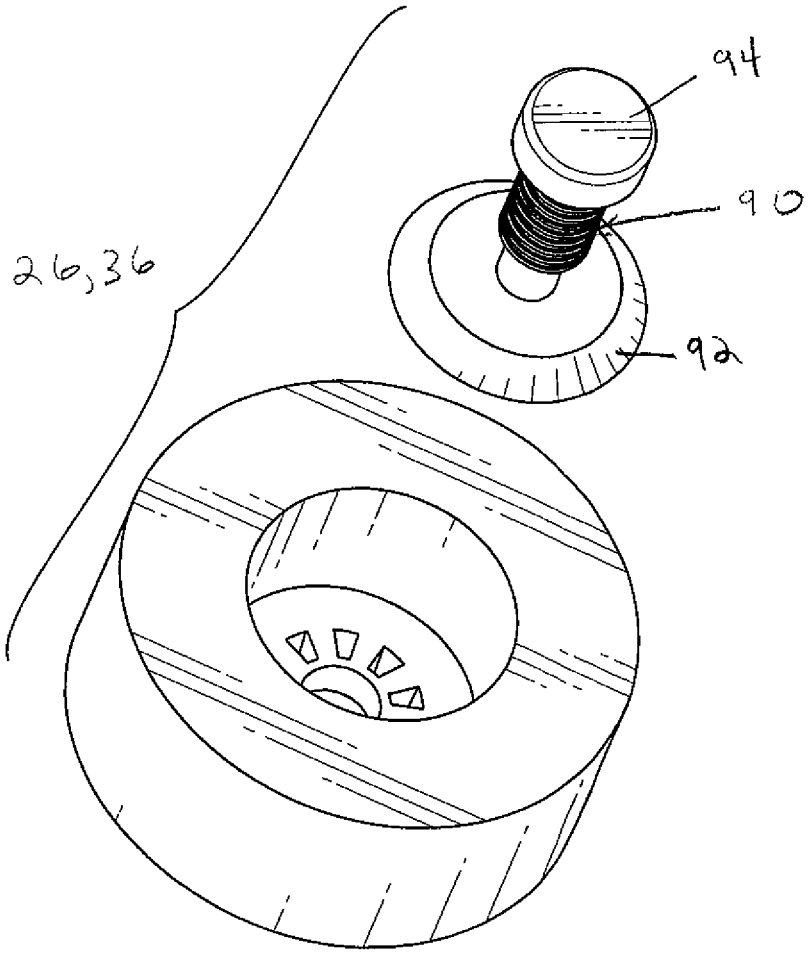
FIG. 11 is an exploded view of the bottom female valve with the spring shown above the bottom section.

Further, as shown in FIGS. 7 and 8, the first male valve 24, the second male valve 34, and the third and fourth male valves may each include a pull handle 80 to facilitate drinking from the first neck 20, the second neck 30, and third and fourth top necks of the first cylindrical body 12, second cylindrical body 14, and third cylindrical body 16. Further, as shown in FIGS. 9, 10, and 11, the first female valve 26, the second female valve 36, and the third and fourth female valves may each include a top member 92, a bottom member 94, and a spring 90 for being compressed when each of the first male valve 24, second male valve 34, and third and fourth male valves are inserted into the first female valve 26, and second female valve 36, and third and fourth female valves respectively.

In addition, the first neck 20, second neck 30, and third and fourth top necks may each respectively have a first thread 20*a*, a second thread 30*a*, and third and fourth threads for lockedly and detachably inserting the first neck 20, second neck 30, and third and fourth top necks respectively into the respective first bottom recess 22, second bottom recess 32, and the third and fourth bottom recesses. Further, the first bottom recess 22, the second bottom recess 32, and the third and fourth bottom recesses may each have a respective first thread 22*a*, second thread 32*a*, and third and fourth threads for lockedly and detachably receiving the respective the first neck 20, second neck 30, and third and fourth top necks respectively.

In the specification the terms "comprise, comprises, comprised and comprising" or any variation thereof and the terms "include, includes, included and including" or any variation thereof are considered to be totally interchangeable and they should all be afforded the widest possible interpretation.

ADVANTAGES OF THE PRESENT INVENTION

An advantage of the present invention is to provide a fluid container for having stackable sections connected by valves for transmitting fluid between the sections.

Another advantage of the present invention is to provide male and female valves at the top and bottom of each section for interlocking with the valves of adjacent sections.

Another advantage of the present invention is to provide a fluid container for having stackable sections connected by valves for a leak proof type connection between the stackable sections.

Another advantage of the present invention is to provide a fluid container which permits the selective connection of multiple adjacent valved fluid containers.

Another advantage of the present invention is to provide a fluid container which permits the selective mixing of different liquids, powders, including for example, powdered ice tea, coffee, baby formula, sports drink mixtures, vitamins, or fruits, etc. by simply selectively connecting adjacent containers filled with the respective desired contents to be mixed.

Another advantage of the present invention is to provide a fluid container such that when adjacent containers containing the desired contents are connected, their contents can be selectively mixed since the valves permit the user to selectively control the amount of contents to flow from one adjacent container to the other.

Another advantage of the present invention is to provide a fluid container which provides for a stacked, valved container that is easily portable on all types of vehicles, including cars, planes boats, etc.

Another advantage of the present invention is to provide a fluid container that is selectively and reusably connectable without causing any spillage of the contents of each separately valved container sections.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A fluid container adapted for leak proof connection with one or more additional fluid containers, comprising:

a) a first cylindrical body with a first top neck and a first bottom recess stacked with at least a second cylindrical body with a second top neck and a second bottom recess;

b) said second top neck of said second body received within the first bottom recess of said first body;

c) a first male valve received in said first top neck of said first body and a second male valve received within said second top neck of said second body;

d) a first female valve received within the first bottom recess of said first body and a second female valve received in said second bottom recess of said second body; and e) when said first and second bodies are vertically stacked, said second male valve of said second body is received within said first female valve of said first bottom recess of said first body for allowing movement of liquid between first and second bodies.

2. The fluid container in accordance with claim 1, further comprising a third cylindrical body with a third top neck and a third bottom recess, a third male valve received in said third top neck of said third cylindrical body, and a third female valve received within the third bottom recess of said third cylindrical body; and wherein said second female valve receives said third male valve within said second female valve of said second bottom recess of said second cylindrical body.

3. The fluid container in accordance with claim 2, further comprising a fourth cylindrical body with a fourth top neck and a fourth bottom recess, a fourth male valve received in said fourth top neck of said fourth cylindrical body and wherein said third female valve receives said fourth male valve within said third female valve of said third bottom recess of said third cylindrical body.

4. The fluid container in accordance with claim 1, wherein said male valves each include a spring that is compressed upon insertion into each of said female valves.

5. The fluid container in accordance with claim 1, wherein said male valves each include a notch that allows them to be locked when they are compressed upon insertion into each of said female valves.

6. The fluid container in accordance with claim 1, wherein said male valves each include a pull handle to facilitate drinking from said top necks of said bodies and to facilitate cleansing of said fluid container.

7. The fluid container in accordance with claim 1, wherein said female valves each include a spring that is compressed when each of said male valves is inserted into said female valves.

8. The fluid container in accordance with claim 1, wherein said top necks have threading for lockably and detachably inserting said top necks into said bottom recesses.

9. The fluid container in accordance with claim 1, wherein said bottom recesses have threading for lockably and detachably receiving said top necks.

* * * * *